US006981933B2

(12) United States Patent
Scafidel

(10) Patent No.: US 6,981,933 B2
(45) Date of Patent: Jan. 3, 2006

(54) EXERCISE DEVICE

(76) Inventor: Bobby Joe Scafidel, P.O. Box 578, Magnolia, MS (US) 39652

( * ) Notice: Subject to any disclaimer, the term of this patent is extended or adjusted under 35 U.S.C. 154(b) by 307 days.

(21) Appl. No.: 10/616,592

(22) Filed: Jul. 10, 2003

(65) Prior Publication Data

US 2005/0009670 A1 Jan. 13, 2005

(51) Int. Cl.
*A63B 21/06* (2006.01)

(52) U.S. Cl. ..... 482/110; 482/93

(58) Field of Classification Search ..... 482/92–94, 482/106–112; 473/594; 446/419
See application file for complete search history.

(56) References Cited

U.S. PATENT DOCUMENTS 1,005,791 A * 10/1911 Angell ..... 482/93
3,163,421 A * 12/1964 Matyko ..... 473/594
3,756,592 A * 9/1973 Johnson ..... 482/110
3,843,117 A * 10/1974 Johnson ..... 482/110
4,538,806 A * 9/1985 Wilkerson ..... 482/108
4,986,535 A * 1/1991 Hull et al. ..... 482/93
5,312,314 A * 5/1994 Stephan et al. ..... 482/110
5,393,285 A * 2/1995 Fischer, Sr. et al. ..... 482/108
5,716,305 A * 2/1998 Selsam ..... 482/93
6,149,555 A * 11/2000 Kinback ..... 482/93
2004/0082445 A1 * 4/2004 Zabel ..... 482/109
2004/0176225 A1 * 9/2004 Chen ..... 482/109

* cited by examiner

*Primary Examiner*—Jerome W. Donnelly
*Assistant Examiner*—Victor K. Hwang
(74) *Attorney, Agent, or Firm*—Schwartz Law Firm P.C.

(57) ABSTRACT

An exercise device includes a hollow housing and a plurality of loose weights contained in the housing. First and second handles are located on opposite sides of the housing. The handles are adapted for being gripped by a user to lift and hold the exercise device.

13 Claims, 4 Drawing Sheets

EXERCISE DEVICE

TECHNICAL FIELD AND BACKGROUND OF THE INVENTION

This invention relates to an exercise device especially applicable for trimming, shaping, toning, and conditioning the hips, arms, obliques, abs, chest, and shoulders of the user. Unlike traditional exercise devices which use a static weight, the present invention incorporates a dynamic weight which shifts when the device is carried in one direction, stopped, and carried back in the opposite direction in a continuous fluid motion. The shifting weight promotes increased range of body motion, and increased muscle resistance when reversing movement. The invention may be used in any high impact, low impact, or no impact aerobic or anaerobic activity. The invention may also be used in a seated position, or while jogging, walking, or standing.

SUMMARY OF INVENTION

Therefore, it is an object of the invention to provide an exercise device which incorporates a dynamic, shifting weight.

It is another object of the invention to provide an exercise device which can be custom designed to meet the needs of the particular user.

It is another object of the invention to provide an exercise device which may be used while seated, or while jogging, walking, or standing.

It is another object of the invention to provide an exercise device which promotes an increased range of body motion.

It is another object of the invention to provide an exercise device which is especially applicable for use while stretching.

It is another object of the invention to provide a method of exercising which trims, shapes, tones, and conditions the hips, arms, obliques, abs, chest, and shoulders.

These and other objects of the present invention are achieved in the preferred embodiments disclosed below by providing an exercise device including a hollow housing and a plurality of loose weights contained in the housing. First and second handles are located on opposite sides of the housing. The handles are adapted for being gripped by a user to lift and hold the exercise device.

According to another preferred embodiment of the invention, an outer casing surrounds the housing.

According to another preferred embodiment of the invention, the casing has first and second pairs of integrally-formed handle flanges for attaching the first and second handles.

According to another preferred embodiment of the invention, the housing is a cylindrical container cradled within the outer casing.

According to another preferred embodiment of the invention, the first and second handles extend perpendicular to a longitudinal axis of the cylindrical container.

According to another preferred embodiment of the invention, the casing is formed of a molded plastic material.

According to another preferred embodiment of the invention, the weights includes rolling metal objects.

Preferably, the metal objects are shot pellets.

According to another preferred embodiment of the invention, the pellets occupy between 50% and 90% of the volume inside the hollow housing.

In another embodiment, the invention is a method of exercising which includes the step of grasping first and second handles of an exercise device. The exercise device includes loose weights contained in a hollow housing. While holding the exercise device in both hands, the user extends the arms forward of the body. The upper and lower body are then repeatedly rotated in opposite directions in a twisting motion. The loose weights contained in the housing generate momentum in a direction of the upper body rotation thereby increasing the range of body movement and increasing the energy required to begin rotation of the upper body back in the opposite direction.

The term "upper body" is defined broadly herein as that portion of the body extending from the waist up, including the arms, abs, chest, and shoulders. The term "lower body" is that portion of the body extending from the waist down, including the waist, hips, and legs.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
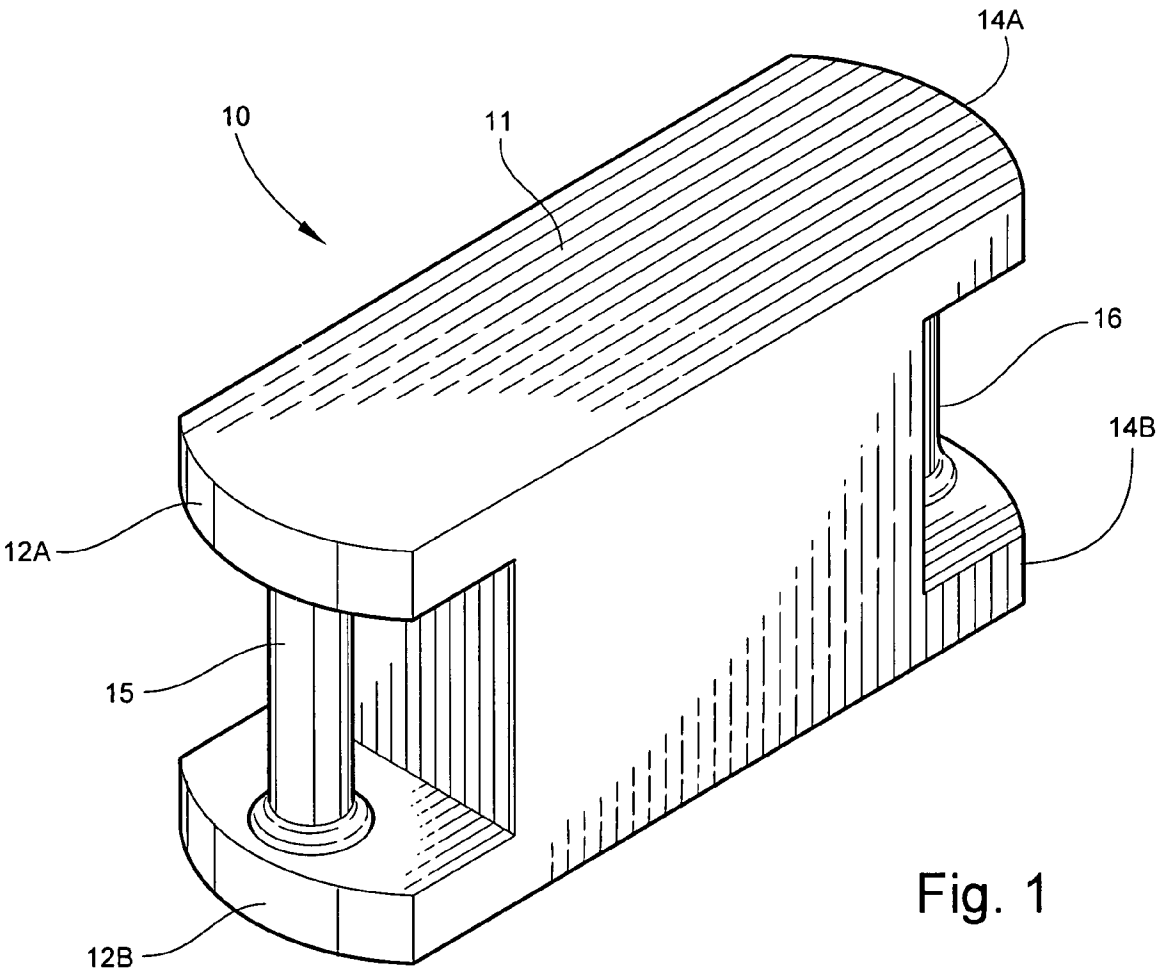
FIG. 1 is a perspective view of an exercise device according to one preferred embodiment of the present invention.
Figure 2:
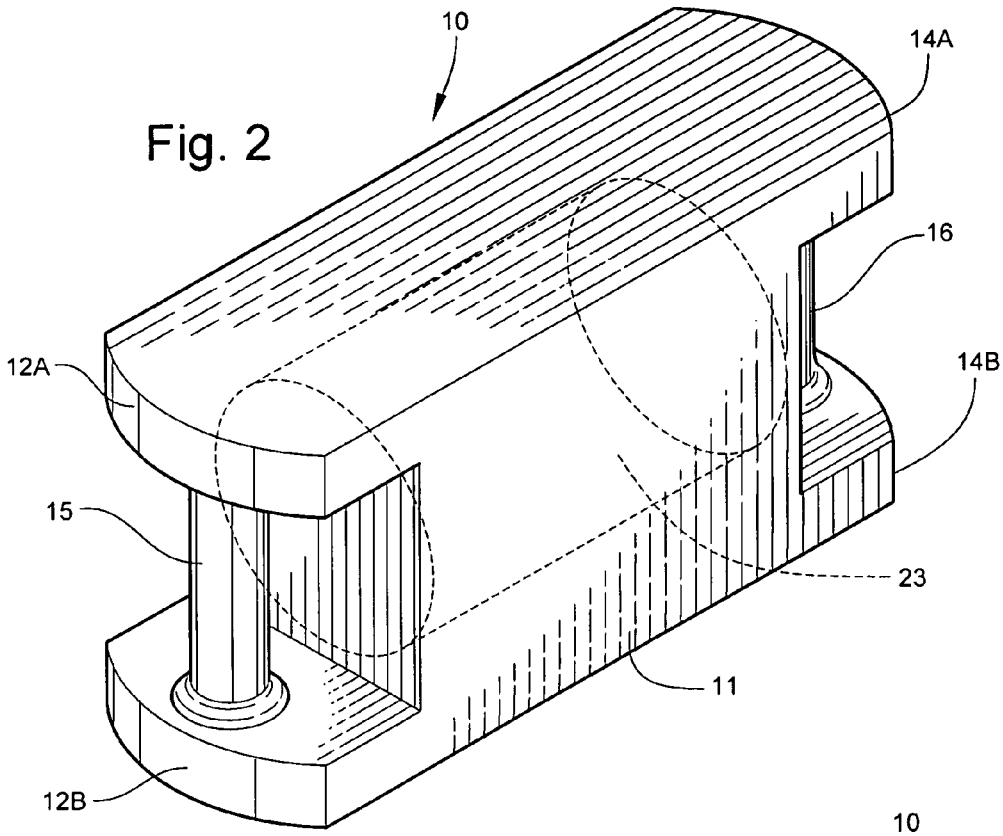
FIG. 2 is a further perspective view of the exercise device showing the cylindrical housing in phantom.
Figure 3:
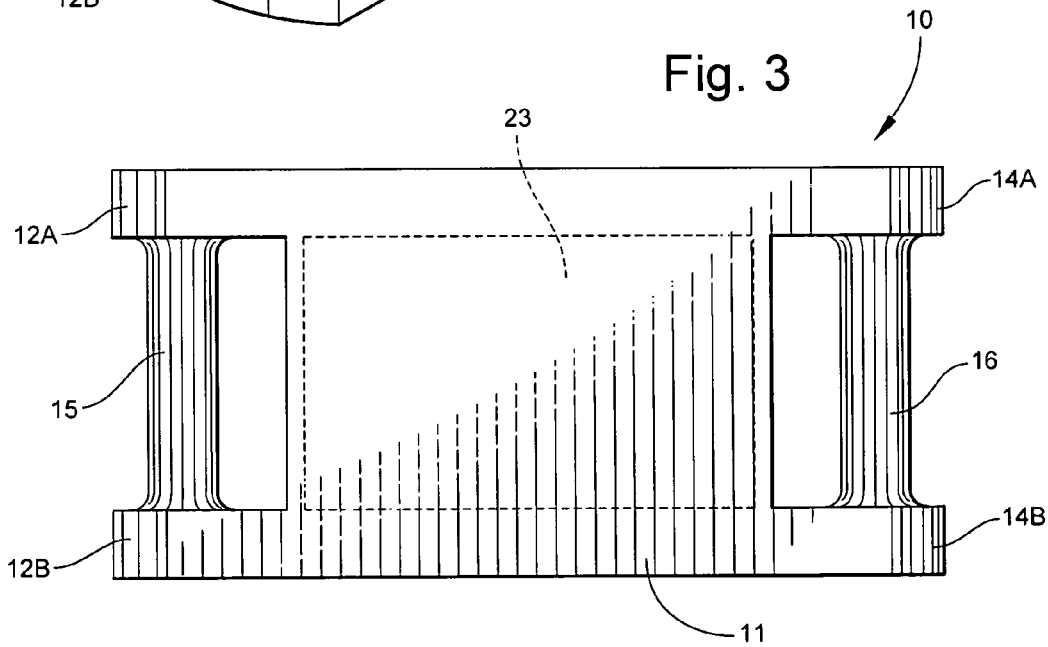
FIG. 3 is a side elevation of the exercise device with the cylindrical housing shown in phantom.
Figure 4:
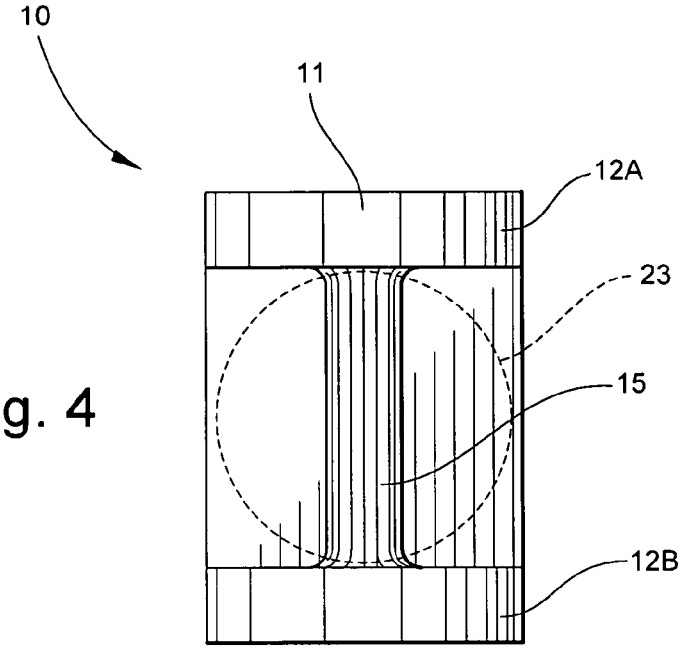
FIG. 4 is an end elevation of the exercise device with the cylindrical housing shown in phantom.
Figure 5:
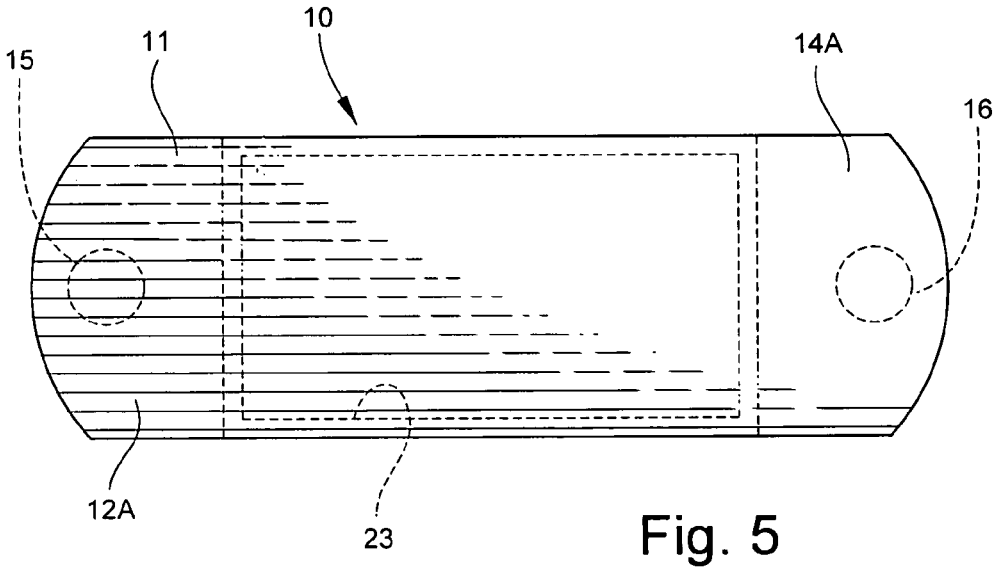
FIG. 5 is a top plan view of the exercise device with the cylindrical housing and handles shown in phantom.
Figure 6:
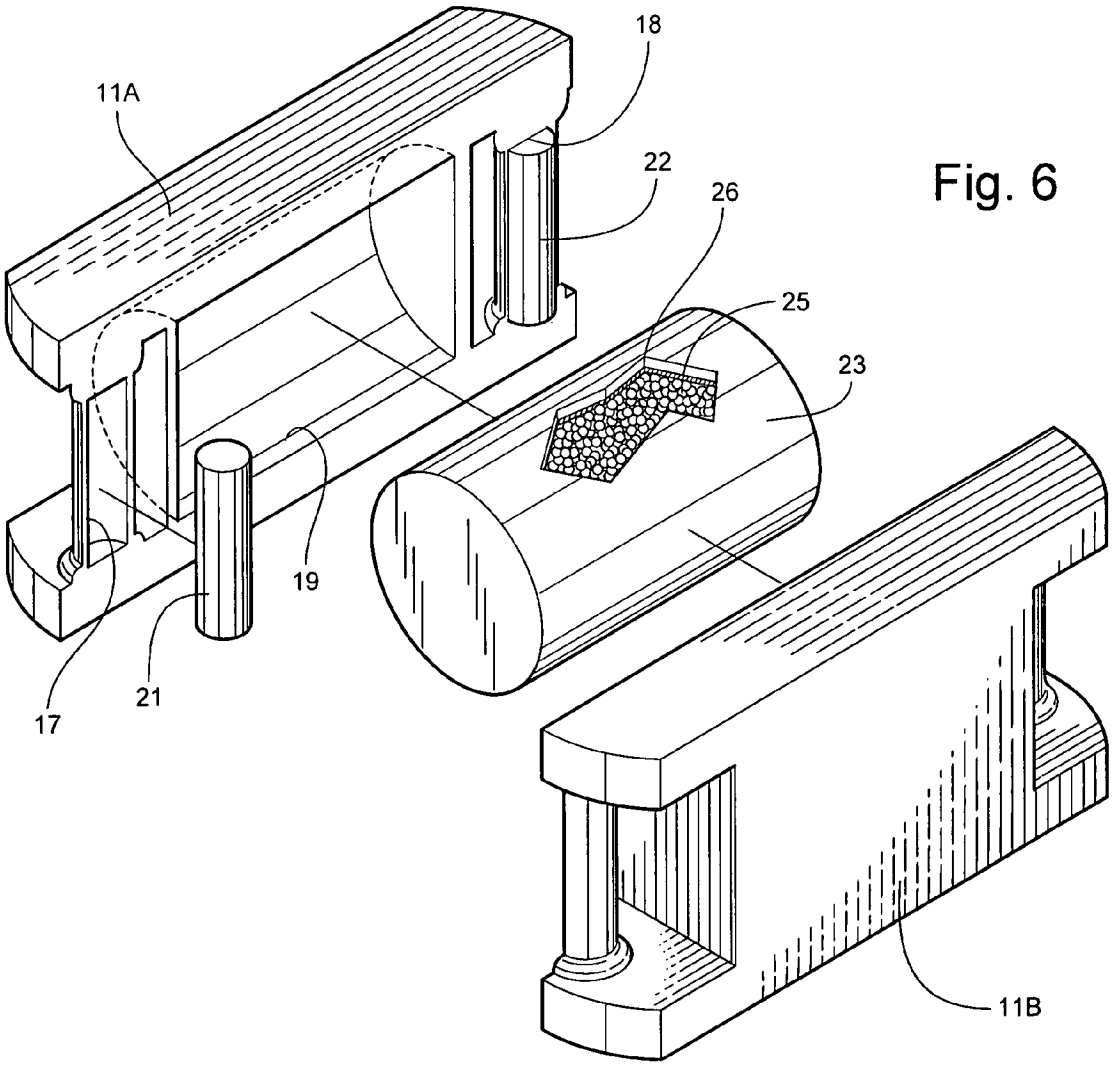
FIG. 6 is an exploded, perspective view of the exercise device with a portion of the housing wall broken away to show the loose shot pellets contained in the housing.

Referring now specifically to the drawings, an exercise device according to the present invention is illustrated in FIG. 1, and shown generally at reference numeral 10. As shown in FIGS. 1 and 2, the device 10 includes an outer casing 11 with opposing pairs of integrally-formed handle flanges 12A, 12B and 14A, 14B. Respective handles 15 and 16 extend between the flanges 12A, 12B and 14A, 14B. The casing 11 is preferably molded in separate halves 11A and 11B, as shown in FIG. 3, each halve defining contoured recessed cavities 17, 18, and 19 shaped to receive metal bars 21, 22 and a cylindrical weight housing 23. When assembled, the casing halves 11A, 11B cooperate to securely retain and cradle the bars 21, 22 and housing 23. The bars 21, 22 serve to reinforce the handles 15, 16, and to increase the overall weight of the exercise device 10. The handles 15, 16 are disposed perpendicular to a longitudinal axis of the housing 23.

As best illustrated in FIGS. 3, 4, 5, and 6, the cylindrical housing 23 is precisely centrally located within the outer casing 11 to provide even distribution of static weight to each arm of the user. The weight housing 23 contains a loose collection of rolling metal objects, such as shot pellets 25 (See FIG. 2). The pellets 25 occupy between 50% and 90% of the total volume inside the cylindrical housing 23 such that the weight of the exercise device 10 shifts when the device 10 is moved back and forth by the user. Shifting of the pellets 25 inside the housing 23 creates a rhythmic sound which aids in the timing of the exercise movements. To reduce the noise created by the pellets 25, a sound suppressant fabric 26 or other material may be provided adjacent the interior of the housing 23.

According to one preferred embodiment, the approximate width of the exercise device 10 is 12 inches, the height is 6 inches, and the depth is 4 inches. The handles 15, 16 are approximately 1-inch in diameter and 4 inches in height. The diameter of the cylindrical housing 23 is approximately 4 inches, and the length approximately 6 inches. In this embodiment, the weight of the exercise device 10 ranges from 10 to 15 pounds. The device 10 may be made larger and heavier, or smaller and lighter to accommodate the needs of the particular user. Preferably, all edges of the exercise device 10 are rounded and smooth with no sharp or squared corners.

The exercise device 10 is used by grasping both handles 15, 16 and extending the arms forward of the body with the elbows slightly bent. While holding the device 10 in this position at a point below shoulder level, the user then repeatedly rotates the upper and lower body in opposite directions in a twisting motion. The loose shot pellets 25 contained in the cylindrical housing 23 generate momentum in a direction of the upper body rotation. This momentum increases the range of rotation of the upper body, and the energy required to begin rotation of the upper body back in the opposite direction. The repeated twisting motion exercises the entire body, and is especially applicable for trimming, shaping, toning, and conditioning the hips, arms, obliques, abs, chest, and shoulders. The exercise is best performed in a rhythmic motion with music, and may be done with low or high impact aerobic activity.

An exercise device is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. An exercise device, comprising:

(a) a hollow housing:

(b) a plurality of loose weights contained in said housing;

(c) first and second handles located on opposite sides of said housing, and adapted for being gripped by a user to lift and hold said exercise device; and (d) an outer casing surrounding said housing, said casing comprising first and second pairs of integrally-formed handle flanges for attaching said first and second handles.

2. An exercise device according to claim 1, wherein said housing comprises a cylindrical container cradled within said outer casing.

3. An exercise device according to claim 2, wherein said first and second handles extend perpendicular to a longitudinal axis of said cylindrical container.

4. An exercise device according to claim 3, wherein said casing is formed of a molded plastic material.

5. An exercise device according to claim 1, wherein said weights comprise rolling metal objects.

6. An exercise device according to claim 5, wherein said metal objects comprise shot pellets.

7. An exercise device according to claim 6, wherein said pellets occupy between 50% and 90% of the volume inside said hollow housing.

8. An exercise device, comprising:

(a) an outer casing;

(b) a hollow cylindrical housing located inside said casing;

(c) a plurality of loose weights contained in said housing; and (d) first and second handles attached to said casing on opposite sides of said housing, and adapted for being gripped by a user to lift and hold said exercise devices, wherein said casing comprises first and second pairs of integrally-formed handle flanges for attaching said first and second handles.

9. An exercise device according to claim 8, wherein said first and second handles extend perpendicular to a longitudinal axis of said cylindrical housing.

10. An exercise device according to claim 9, wherein said casing is formed of a molded plastic material.

11. An exercise device according to claim 8, wherein said weights comprise rolling metal objects.

12. An exercise device according to claim 11, wherein said metal objects comprise shot pellets.

13. An exercise device according to claim 12, wherein said pellets occupy between 50% and 90% of the volume inside said hollow housing.

* * * * *